United States Patent [19]

Chap

[11] Patent Number: 4,673,089

[45] Date of Patent: Jun. 16, 1987

[54] SLIDING MUG/CUP ORGANIZER

[75] Inventor: John P. Chap, Lemont, Ill.

[73] Assignee: Selfix, Inc., Chicago, Ill.

[21] Appl. No.: 788,943

[22] Filed: Oct. 18, 1985

[51] Int. Cl.[4] ..... A47F 5/01

[52] U.S. Cl. ..... 211/71; 211/94; 211/119

[58] Field of Search ..... 211/113, 119, 90, 94, 211/162, 71

[56] References Cited

U.S. PATENT DOCUMENTS

| | | | |
|---|---|---|---|
| 2,606,666 | 8/1952 | Gray | 211/113 |
| 3,252,583 | 5/1966 | Walther et al. | 211/119 |
| 3,730,355 | 5/1973 | Feldman | 211/90 X |
| 4,456,125 | 6/1984 | Chap | 211/119 X |

*Primary Examiner*—Robert W. Gibson, Jr.

*Attorney, Agent, or Firm*—Dressler, Goldsmith, Shore, Sutker & Milnamow, Ltd.

[57] ABSTRACT

A mug/cup organizer has a formed wire clip that can slidably engage a shelf; a wire support framework slidably engages the clip adjacent the lower surface of the shelf; a plurality of downwardly extending hooks is attached to the framework. The mugs or cups can be hung from the hooks. The framework can be slid from under the shelf, while being supported by the clip, to remove cups from or hang cups thereon. The clip, framework and hooks can be formed of attractive, clean, metal-plated wire.

23 Claims, 3 Drawing Figures

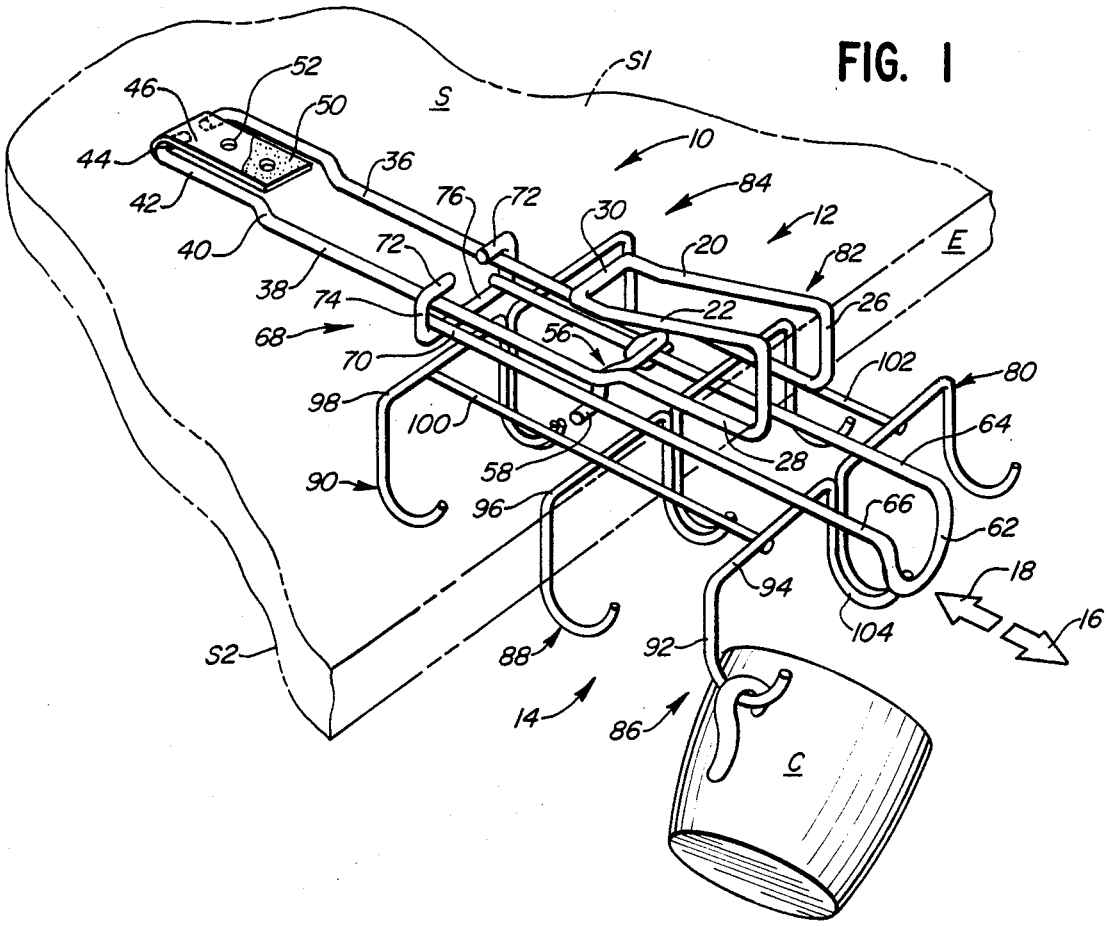
FIG. 1
FIG. 2
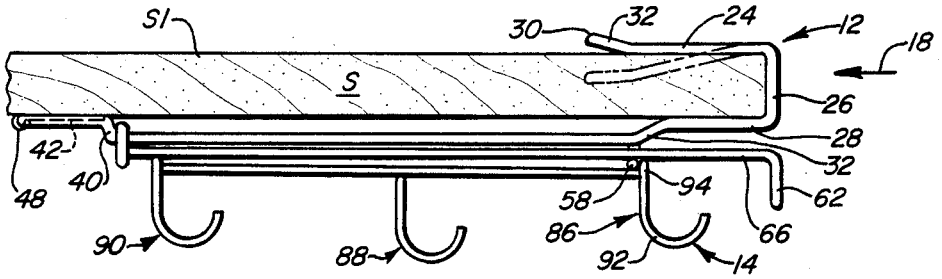
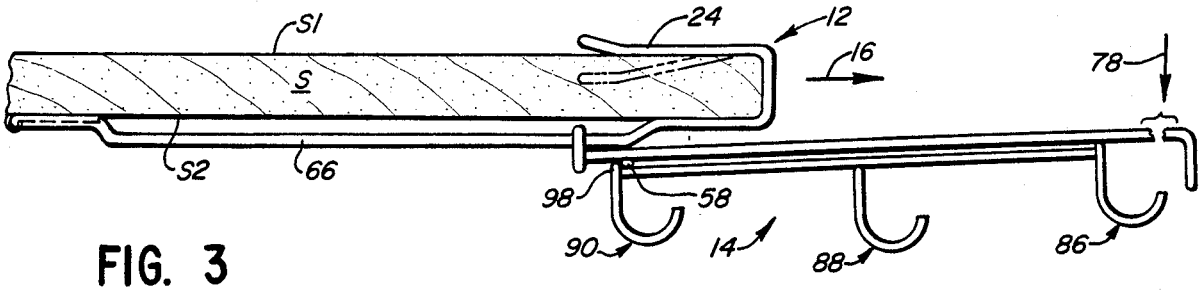
FIG. 3

SLIDING MUG/CUP ORGANIZER

FIELD OF THE INVENTION

The invention pertains to shelf-mounted organizers. More particularly, the invention pertains to shelf-mountable, slidable hangers for articles.

BACKGROUND OF THE INVENTION

Plated and coated wire products find wide use in shelves, racks and other household conveniences. Products of this type are usually fabricated from metal wire formed to an appropriate shape and then plated or coated with a vinyl or other plastic material. The resultant plated or coated wire product is corrosion resistant. The plating or plastic coating is available in a variety of colors and provides a pleasing appearance. In addition, the coated plastic surface is readily cleanable.

For example, coated, stackable shelf units are disclosed in U.S. Pat. No. 4,444,320 entitled STACKABLE SHELF UNIT. Hangable, stackable basket units are disclosed in U.S. Pat. No. 4,456,125 entitled HANGABLE STACKABLE BASKET.

For many years metal hooks have been used to hang mugs or cups from a lower surface of a shelf in a cupboard. The use of such hooks provides for more efficient storage of the cups in view of the fact that merely placing the cups on the shelf in the cupboard makes no use of the space between the top of the cups and the next higher shelf. Often, it is undesirable to stack the cups one on top of the other because they are fragile and are readily breakable.

Prior art metal hooks for cups have come in a variety of forms including individual hooks which can be screwed into the lower surface of a shelf. Alternately, pluralities of hooks can be joined together and fastened to the underside of a shelf as a single unit. Cup- or mug-supporting assemblies have also been made of plastic-covered wire. Such assemblies have included a plate attachable to a bottom surface of a shelf. A rotary cup holder can be hung from or attached to the plate.

Separate hooks suffer from the fact that each must be individually screwed into the lower surface of a shelf. A plurality of hooks attached to a single mounting plate can be affixed to a shelf somewhat easier than can the individual hooks. However, all such assemblies have been installed by attaching the hooks or the mounting plate to a lower surface of a shelf using screws or like fasteners.

In many instances where an occupant is only a temporary resident, it is undesirable to use screws or other fasteners because of the resultant marks that are left in the cabinets. There is, therefore, a need for a hanging rack/organizer assembly which can easily be attached to a shelf but which does not require fasteners of the type which can scar or damage the cabinetry.

Both the separate hooks and the combined hooks also suffer from the need to reach into the cabinet to hang cups on the hooks or to remove cups from the hooks. Hence, there continues to be a need for an extendable organizer that can be conveniently moved, at least in part, from under the shelf to which it is attached.

Thus, there continues to be a need for organizers or hangers usable with mugs or cups which can easily be installed. Further, there continues to be a need for hangers usable with mugs or cups which provide convenient access to the mugs or cups and which can readily be kept clean.

SUMMARY OF THE INVENTION

In accordance with the invention, an easy to use mug/cup organizer is provided. An organizer that embodies the present invention includes a formed wire clip for slidably engaging a shelf. Coupled to and movable with respect to the formed wire clip is a formed wire framework. A plurality of article supporting means can be attached to the formed wire framework. In one form of the invention, the article supporting means can be a plurality of hooks. Mugs, cups or other articles can be hung from the hooks.

The formed wire clip can include two spaced-apart, U-shaped members which are joined by a short, transverse, connecting member. The U-shaped members can slidably engage the shelf under which the cups are to be hung. A pair of elongated straight wire guide members extends distally from the U-shaped members, adjacent the lower surface of the shelf. The elongated straight wire guide members terminate at and are joined by an attachment means. The attachment means is effective to connect the clip to the lower surface of the shelf.

The supporting framework has a generally elongated, rectangular shape. A pair of spaced apart, straight, members are joined by a manually engageable loop. Distally of the loop, the two spaced apart straight members are joined by a slider. A plurality of article support means is attached to the supporting framework.

The article support means can include a plurality of hooks. Alternately, the article support means could include another shelf.

The slider of the supporting framework engages the pair of elongated straight guide members of the clip. The supporting framework is thus movable with respect to the clip from the position beneath the shelf to a position extending out from the shelf.

The clip is attached to the shelf. The two U-shaped members grippably engage the upper and lower surfaces of the shelf adjacent the edge thereof. The two elongated straight members of the clip extend away from the edge and are attached to the underside of the shelf.

The supporting framework extends beneath the shelf and is slidably carried on the guide members by the spaced apart, elongated, straight members of the clip. As the supporting framework is moved with respect to the clip, it slides by means of the above-noted, slide, on the two elongated guide members fastened to the underside of the shelf.

A person wishing to access one or more of the cups, or other articles, hanging from or otherwise supported by the organizer merely pulls on the loop which is located by the front edge of the shelf. The supporting framework moves forward, out from underneath the shelf. The cups or articles can thus be readily accessed. Once the cups or other articles have been removed, the supporting framework can then be slidably returned to its retracted position under the shelf.

A stop member limits the travel of the supporting framework as it is pulled from under the shelf and as it is pushed back under the shelf. The stop member can be a laterally extending stud formed on the clip.

The wire material can be plated or anodized. Alternately, a hard plastic coating can be used. The number of hooks and their shape can vary as needed. The configurations of the hooks or article support members are not a limitation of the present invention.

Numerous other advantages and features of the present invention will become readily apparent from the following detailed description of the invention and the embodiments thereof, from the claims and from the accompanying drawings in which the details of the invention are fully and completely disclosed as a part of this specification.

DESCRIPTION OF THE DRAWING

FIG. 1 is a perspective view of an under-shelf organizer embodying the present invention which is positioned on a shelf shown in phantom;

FIG. 2 is a side elevational view of the cup organizer of FIG. 1 illustrating the relationship of the elements when the organizer is in a retracted position; and FIG. 3 is a side elevational view of the cup organizer of FIG. 1 illustrating the relationship of the elements when the organizer is in an extended position.

DETAILED DESCRIPTION OF THE PREFERRED EMBODIMENT

While this invention is susceptible of embodiment in many different forms, there is shown in the drawing and will be described herein in detail a specific embodiment thereof with the understanding that the present disclosure is to be considered as an exemplification of the principles of the invention and is not intended to limit the invention to the specific embodiment illustrated.

FIG. 1 illustrates a cup organizer 10 in accordance wth the present invention. The organizer 10 is positioned on a shelf S, shown in phantom, and supports an exemplary mug or cup C. The cup organizer 10 is affixed to the spaced-apart, essentially horizontal shelf surfaces S1 and S2. The cup organizer 10 includes a shelf clip 12 that slidably engages the surfaces S1 and S2 of the shelf S. The shelf clip 12 can be rigidly affixed to the shelf S.

The cup organizer 10 also includes a supporting framework 14. The framework 14 is slidably coupled, adjacent the undersurface S2 of the shelf S, to the shelf clip 12. The supporting framework 14, as indicated by arrows 16 and 18, can be moved from a retracted position under the shelf S, as shown in FIG. 2, adjacent the surface S2, to a position as shown in FIG. 3 extending out from the shelf S. The supporting framework 14 is illustrated in FIG. 1 partly extended from beneath the shelf S.

Both the shelf clip 12 and the supporting framework 14 can be formed of plated or anodized wire. The plated wire is corrosion resistant and is easily cleanable.

The shelf clip 12 is formed of two, spaced-apart, U-shaped resilient members 20 and 22. Each of the U-shaped members 20 and 22 includes an upper resilient leg 24 which slidably engages the surface S1 of the shelf S. A central leg 26 is attached to a proximal end of the resilient leg 24. The central member 26 is positionable against an edge E of the shelf S. A lower leg 28 is connected to a lower end of the central leg 26 and is positionable adjacent the lower surface S2 of the shelf S.

As best can be seen in FIG. 2, when the shelf clip 12 is slid onto the shelf S, the resilient upper leg 24 is deflected from its initial position, shown in phantom in FIG. 2, to a position essentially parallel to the upper surface S1 of the shelf S. This deflection of the leg 24 provides for resiliently clamping the shelf S. The shelf clip 12 is thus firmly supported in its desired position, as shown in FIG. 2, adjacent the front edge E of the shelf S.

The two U-shaped members 20 and 22 of the shelf clip 12 are joined by a short lateral member 30. When installed on the shelf S, the member 30 is adjacent the surface S1. The lateral member 30 is offset from the surface S1 by biased member 32. The biased member 32 is bent at about a 12° angle with the respect to the upper leg 24. This angle facilitates insertion of the shelf clip 12 onto the shelf S.

A pair of spaced-apart linear guide members 36 and 38 extends distally of the U-shaped members 20 and 22, adjacent the lower surface S2 of the shelf S. The elongated linear guide members 36 and 38 each are offset a selected amount from the lower surface S2 by an offset member 32. The guide members 36 and 38 provide a guide and a support along which the support framework 14 slides when it is moved in the direction 16 or the direction 18 with respect to the shelf clip 12.

The guide members 36 and 38 each include a second, integrally formed offset member 40. Attached to each second offset member 40 is terminating linear region 42. Each terminating region 42 is positionable adjacent the surface S2. A tab 44, bent at right angles to the region 42, terminates each end of the shelf clip 12. The tab 44 is also positionable adjacent the surface S2 as seen in FIG. 1.

An attachment plate 46 joins the tabs 44. The plate 46 has an integrally formed collar 48, best seen in FIG. 2, that wraps around the tabs 44. The attachment plate 46 provides an anchor for the clip 12.

A layer of adhesive 50 can be applied to the plate 46. The adhesive layer 50 can be used to anchor the shelf clip 12 to the surface S2 of the shelf S. Alternately, the plate 46 can be mechanically affixed to the lower surface S2 of the shelf S by screws, nails or the like by means of holes 52.

The shelf clip 12 can be conveniently and rigidly affixed to the shelf S through the cooperation of the U-shaped members 20,22 and the plate 46. If the adhesive layer 50 is used, no screws are needed. Alternately, one or two screws can be inserted into the shelf S through the holes 52 to anchor the clip 12.

A support and stop member 56 is affixed to the shelf clip 12 adjacent the biasing members 32. The stop member 56 includes first and second laterally extending support studs 58. The laterally extending studs 58 provide a load bearing surface upon which the support framework 14 slides. Further, as will be discussed subsequently, the members 58 block retracting movement of the support framework 14 under the shelf S in the direction 18 when that element is fully retracted, as in FIG. 2. The members 58 also block extending movement in the direction 16 when the framework 14 is fully extended as in FIG. 3.

The support framework 14 is formed with a manually engageable loop 62 positionable adjacent the front edge E of the shelf S. The loop 62 can be easily engaged by someone wishing to move the support framework 14 in the direction 16 to its extended position.

A pair of elongated parallel extension elements 64 and 66 is formed integrally with the loop 62. The extension elements 64 and 66 cooperate with and slide upon the studs 58 as the framework 14 is moved in the direction 16 or 18. Distal ends 70 of the extension elements 64 and 66 terminate in a C-shaped sliding element 68.

The slider element 68 includes a pair of end members 72 which overlap the elongated supporting elements 36 and 38. The end members 72 are joined by studs 74 to a central connecting member 76. The slider element 68, not only surrounds and cooperates with the guide members 64 and 66, but it also enhances the rigidity and strength of the organizer 10.

The slider 68 cooperates with the elongated members 36 and 38 to maintain the support framework 14 in proper alignment as that framework is being extended or retracted in the directions 16 or 18. When the support framework 14 is in its retracted position, as in FIG. 2, the overlapping members 72 support the ends 70 of the framework 14 from the top while at the same time, the studs 58 support the members 64, 66 adjacent the loop 62 from beneath.

In the extended position, the framework 14, as illustrated in FIG. 3, tends to pivot about the studs 58 in a direction 78. This pivotal motion is opposed by the central connecting region 76 of the slider 68. Cooperation between the studs 58 and the central connecting region 76 thus retains the support framework 14 in the extended position as illustrated in FIG. 3, even when a full compliment of cups or mugs is being supported.

Affixed to lower surfaces of the elongated members 64 and 66 are a plurality of cup supporting hook elements 80 through 90. Each of the hook elements 80 through 90 is formed with a pair of cup supporting hooks of which the hook 92 is typical.

Each of the hook elements, 80 through 90, includes a laterally extending member such as the member 94, the member 96 or the member 98 of the respective hook elements 86, 88, 90. Each of the lateral members 94 and 98 is affixed to a lower surface of a respective elongated translating member such as the member 66. The lateral members 94 and 98 are each also affixed to an upper surface of a laterally spaced-apart, elongated, linear stabilizing member 100. The stabilizing member 100 extends essentially parallel to the member 66. The lateral element 96 is attached to a lower surface of the stabilizing element 100.

A second stabilizing element 102 is correspondingly affixed to the hook members 80, 82 and 84. The stabilizing element 102 extends parallel to the member 64.

In the retracted condition of FIG. 2, when the support frame 14 has been moved in the direction 18 as far as possible, the lateral member 94 engages the stop element or stud 58. Thereby blocks further movement in the direction 18 of the framework 14.

When the support frame 14 has been moved in the direction 16 to its fully extended position, as best seen in FIG. 3, the lateral member 98 engages the stop element or stud 58. Hence, the framework 14 is blocked from further movement in the direction 16.

The hook elements 80 through 90 may assume a variety of shapes. The exact shape of the hook elements 80 through 90 is not a limitation of the present invention. As can be seen in FIG. 1, in the exemplary configuration shown, the hook elements 80, 86; 82, 88; and 84, 90 are located adjacent one another. A centrally-located, double hook such as the hook 104 is thus formed in each instance.

It will be understood that instead of a plurality of hook members 80–90, alternate article supporting members can be attached to the framework 14. For example, an article supporting shelf can be attached thereto without departing from the spirit and scope of the invention.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

What is claimed is:

1. An article organizing assembly affixable to a panel comprising:

means slidably engageable with the panel for support thereby; and means, coupled to and translatable with respect to said engaging means, for supporting selected articles adjacent to and offset from a surface of the panel, said article supporting means including first and second spaced apart, elongated wire members joined by C-shaped means for translatably coupling said elongated wire members to said engaging means.

2. The article organizing assembly as claimed in claim 1 wherein the panel is oriented essentially horizontally with said engaging means including means for slidably clamping onto spaced apart surfaces of the panel.

3. The article organizing assembly as claimed in claim 2 with said clamping means including a generally U-shaped resilient member for resiliently engaging the surfaces of the panel.

4. The article organizing assembly as claimed in claim 3 wherein said U-shaped resilient member includes a formed wire clip.

5. The article organizing assembly as claimed in claim 4 wherein said formed wire clip has first and second spaced apart, connected, U-shaped regions for resiliently gripping the two spaced apart surfaces of the panel.

6. The article organizing assembly as claimed in claim 5 including two connected, spaced apart, linear wire guide members extending distally of said U-shaped regions of said clip.

7. The article organizing assembly as claimed in claim 6 wherein said linear wire guide members have distal ends joined by means for affixing said ends to a selected surface of the panel.

8. The article organizing assembly as claimed in claim 6 wherein said two linear wire guide members extend adjacent to a selected surface of the panel and offset therefrom.

9. The article organizing assembly as claimed in claim 7 wherein said affixing means includes adhesive means for affixing said clip to the panel.

10. The article organizing assembly as claimed in claim 7 wherein said affixing means includes mechanical means for affixing said clip to the panel.

11. The article organizing assembly as claimed in claim 10 with said mechanical means including a plate joining said linear wire guide members.

12. The article organizing assembly as claimed in claim 1 including means affixed to said elongated wire members for removably supporting the articles.

13. The article organizing assembly as claimed in claim 1 wherein said coupling means includes an elongated, C-shaped slider in slidable, overlapping, relationship with said engaging means.

14. The article organizing assembly as claimed in claim 12 including a manually engageable loop joining said linear, spaced apart support members distally of said coupling means.

15. The article organizing assembly as claimed in claim 14 with said supporting means being movable from a first position to a second position in response to manual engagement with and movement of said loop.

16. The article organizing assembly as claimed in claim 15 including stop means to limit movement of said supporting means in said two directions.

17. The article organizing assembly as claimed in claim 15 with said supporting means including a plurality of hooks for removably supporting the articles.

18. The article organizing assembly as claimed in claim 17 wherein said engaging means and said supporting means comprise plated wire.

19. An organizer for articles positionable on an essentially horizontal member comprising:

a formed wire clip having resilient members for engaging spaced apart surfaces of the horizontal member and integrally-formed linear, spaced apart wire guide members extending distally of said resilient members;

a wire support framework that slidably engages said wire guide members and is manually movable from a first position, adjacent the horizontal member, to a second position, extending therefrom; and a plurality of hook means affixed to said framework for removably receiving articles.

20. The organizer as claimed in claim 19 wherein said wire clip, said wire support framework and said hook means comprise plated wire.

21. The organizer as claimed in claim 19 wherein said wire support framework includes a C-shaped member for slidably supporting said framework on said spaced apart wire guide members.

22. A shelf mountable, article organizing assembly comprising:

shelf engaging means having spaced apart, U-shaped wire members for slidably engaging the shelf and first and second spaced apart, elongated wire guide members with distal ends positionable beneath the shelf; and article supporting means having first an second spaced apart, elongated wire extension members joined at distal ends by a C-shaped sliding member, said C-shaped sliding member slidably engaging said wire guide members for enabling said supporting means to slide thereon, said supporting means being manually movable from a first position beneath the shelf to a second position extending out from the shelf.

23. An assembly as claimed in claim 22 including shelf attachment means located between said distal ends of said wire guide members, affixed thereto, and attachable to the shelf.

* * * * *